US005379911A

United States Patent [19]

Goto et al.

[11] Patent Number: 5,379,911

[45] Date of Patent: Jan. 10, 1995

[54] MOLDED BAG FOR CHILDREN

[76] Inventors: Fumio Goto, 829-4 Kushida, Kurashiki-City, Okayama Prefecture 710-01; Yasumasa Kasahara, 195-3, Yasue, Kurashiki-City, Okayama Prefecture 711, both of Japan

[21] Appl. No.: 859,436

[22] Filed: Jul. 21, 1992

[30] Foreign Application Priority Data

Sep. 27, 1990 [JP] Japan ..... 2-255286

[51] Int. Cl.[6] ..... A45F 3/02

[52] U.S. Cl. ..... 220/339; 383/907; 206/457; 206/542; 220/DIG. 13

[58] Field of Search ..... 224/202, 209, 217, 214, 224/215, 216, 235, 236, 257, 259; 206/457, 541, 542, 547; 383/907; 446/74, 72, 76; D3/45, 66, 44; 220/339, DIG. 13, DIG. 12; 150/100; 190/100

[56] References Cited

U.S. PATENT DOCUMENTS

| | | | |
|---|---|---|---|
| D. 315,444 | 3/1991 | Maddocks | D3/66 |
| 2,359,999 | 10/1944 | Langhofer | 446/74 |
| 3,547,324 | 12/1970 | Parks | 224/235 |
| 3,867,971 | 2/1975 | Hazan | 446/74 |
| 4,088,252 | 5/1978 | Grunberger | 224/8 R |
| 4,174,059 | 11/1979 | Maunder | 224/209 |
| 4,375,828 | 3/1983 | Biddison | 383/907 |
| 4,593,817 | 6/1986 | Ferrero | 220/DIG. 13 |
| 4,643,281 | 2/1987 | Erickson | 190/119 |
| 4,859,822 | 8/1989 | Rasuga et al. | 220/DIG. 13 |
| 5,002,197 | 3/1991 | Ponsi | 220/339 |
| 5,064,088 | 11/1991 | Steffes | 220/339 |
| 5,072,843 | 12/1991 | James | 446/74 |

OTHER PUBLICATIONS

Abstract & Drawing from German patent No. 2,452,899, May 1976, 1 page.

*Primary Examiner*—Stephen Castellano
*Attorney, Agent, or Firm*—Renner, Kenner, Greive, Bobak, Taylor & Weber

[57] ABSTRACT

A molded bag for children having a main body consisting of a front side portion (1) and a rear side portion (2), which are made by molding, said front side portion (1) suitably and precisely representing a complicated tridimensional shape such as a face of an animal, e.g. a panda, said rear side portion (2) being connected at a lower portion thereof, which is closer to the bottom, to said front side portion (1) for forming a vacant space to receive articles, and an upper portion of said rear side portion (2) constituting a lid (10) openable and closable on a hinge portion (4) integrally formed on said rear side portion (2). The lid (10), when closed with respect to the front side portion (1), allows the main body of the bag to form a box construction having satisfactory strength, so that articles contained in the interior thereof are safely protected.

8 Claims, 4 Drawing Sheets

MOLDED BAG FOR CHILDREN

TECHNICAL FIELD

The present invention relates to a bag and the like for children, such as a satchel or school bag, a rucksack and a shoulder bag especially for children, which can be produced by molding.

BACKGROUND ART

There are many types of bags for children known in the art. Some of these are shown in FIGS. 4 through 8 in which FIGS. 4 and 5 represent a rucksack or knapsack to be carried on the back of a child; FIG. 7 represents a satchel or school bag also carried on the back; FIG. 8 illustrates a shoulder bag to be hung on a shoulder and FIG. 6 shows a bag to be carried either with a hand or on a shoulder. There are also handbags or pocketbooks and "pochettes" to be hung on a waist belt, through not shown in the drawings.

These bags are usually made through a manufacturing process including cutting and sewing fabrics of synthetic or natural fibers, or natural or artificial leather, and providing a metallic lock. Some bags are provided with zipper fasteners around the openings so as to improve aesthetic appearance and render them easily usable. In general, many of these bags are made of soft materials so that they can hardly support their tridimensional shapes by themselves. Though some of these handbags have improved stiffness by incorporating reinforcing members in the main bodies, there are few bags of the prior art which are found to be satisfactory in respect of structural strength and stiffness.

The main body in which articles are accommodated in the prior art bags generally has very simple and plain surface configurations which are remote from complicated tridimensional shapes having uneven and irregular contours of, for example, a face of an animal, and very few have designs closely resembling a real animal. So, some measures have been adopted, including attaching to the bags adhesive-backed paper on which pictures are painted, or printing pictures directly on the lids, so as to suit children's tastes and try to win their favor, but these are essentially plain and unsatisfactory deceptive tactics.

Moreover, the lids of the prior art bags serve merely to cover the openings and are not suited to form a reinforcing structure in combination with the main body of the bag.

Thus, children's bags of the prior art have many deficiencies as enumerated below:

(1) They are generally of simple and conventional design and lack uniqueness and variety. In view of materials and methods utilized heretofore for making children's bags, it is very difficult to manufacture bags of characters and/or complicated contours which are precisely defined. Selection of the design of a bag is thus restricted within narrow limits.

(2) As the lid of the prior-art bag can not constitute a dynamically rigid, box-like structure in combination with the main body of the bag, the bag is so unstable that, upon pressing from outside, articles accommodated therein are easily bent or fractured.

Since the bag of the prior art is unstable and easily deformable, an opening of the bag can be made only so large without reducing strength and stiffness of the bag. To achieve shape retentivity of the bag of the prior art necessitates special consideration as to the size of the bag, thickness and density of materials used to form the main body of the bag, and reinforcing materials to improve stiffness of the bag.

(3) Among the lids of children's bags of the prior art are those which are folded through an angle ranging from 180° to 360° to open. The lids of this type are degraded at regions frequently folded, or cracked and virtually fractured.

Another type of lid utilizes zipper fasteners which often bit into articles contained in the bag and, when used for long period of time, weaken at their fabric borders where sewn to the bag.

A further type of the lid of the prior-art bags for children includes metal detents attached to the top of the main body which are twisted for locking and opening the gab. Locking means of this type is not suited to large bags, and in addition, it is deformed and loosened by creeping after long use.

DISCLOSURE OF THE INVENTION

Accordingly, it is an object of the present invention to provide children's bags produced by a molding process capable of obviating deficiencies experienced in the prior-art bags.

It is a specific object of the present invention to provide children's bags which are relatively free from restrictions in designing and are capable of representing unlimited tridimensional contours and providing unconventional appearance and new images.

It is a further object of the present invention to provide a children's bag which has a sufficiently large opening to allow fragile or collapsible articles to be safely inserted therethrough and taken out therefrom and yet which has satisfactory strength and stiffness caused by a box-like construction formed when the large opening is closed and locked by a lid. The lid is molded integrally with the main body of the bag and connected therewith through a hinge structure produced inherently during the molding process.

These and other objects of the invention can be accomplished by:

(a) preparing a model pattern of the main body of the bag for children which may have rather complex shapes, (b) fabricating metallic, wooden or plastic molds for producing the main body of the bag on the basis of the aforementioned model pattern, (c) molding a front half portion and a rear half portion of the main body of the bag with the aforementioned molds by utilizing thermoplastic or thermosetting resins or high molecular fibrous materials, including synthetic fibers, wood, or papers, through an appropriate technique such as injection molding, stamp molding, blow molding, pour molding and so on, and (d) combining the front half portion and the rear half portion of the main body of the bag by closely fitting or engaging the overall circumferential edges of the front and rear halves, respectively, thereby to produce the children's bag having rather complicated tridimensional design and appearance.

In the present invention, the main body of the bags can be produced having various contours, especially tridimensional configurations, resembling various animals, other living, non-living, imaged or created animals, or the characters in stories or animations, without any substantial limitations.

The present invention permits easy and precise production of the bags having complicated contours, which otherwise have been considered impossible or difficult to be manufactured in view of restriction in designing. If necessary, the molded bags produced in accordance with the present invention can have laminations or covering materials such as woven or knitted fabrics or non-woven fabrics applied thereon during or after molding.

As one of the characteristics, the mold employed in the present invention should have a bead portion or portions in the area corresponding to the central portions of the rear half portion of the main body for making a hinge structure on the rear half portion of the bag. Preferably, with this mold, the rear half portion of the bag may be molded from polypropylene to form a plastic hinge structure integrally with the main body of the bag. The plastic hinge of this type may be located in the region corresponding to from 80% to 20% of the longitudinal length (height) of the inside space of the bag for easily inserting and taking out articles, although it should preferably be located substantially in the middle portion of the height. The front half portion and the rear half portion, upon molding, are mated to each other with their concave portions opposed, and combined together to form a box-like construction by means of adhesives or hot melts at the circumferential edges of the lower portions below the plastic hinge, with the upper portions being openable and closable.

On the lid portion above the bendable plastic hinge of the rear half portion, a lock means may be provided which may be fixed on the top portion of the front half portion of the main body. The circumferential edge of the lid of the rear half portion is lapped over or engaged with the circumferential edge of the front half portion thereby to form a stable, box-like structure.

Any animals, persons or characters represented on the bag of the present invention may have eyes and/or a mouth differently colored or tinted, or prepared or processed separately, so as to exhibit stereographical effects.

According to the method of the present invention, various tridimensionally-shaped children's bags of excellent design, including satchels or school bags, shoulder bags, handbags or pocketbooks, and "pochettes" can be easily manufactured.

BEST MODE FOR CARRYING OUT THE INVENTION

Figure 1:
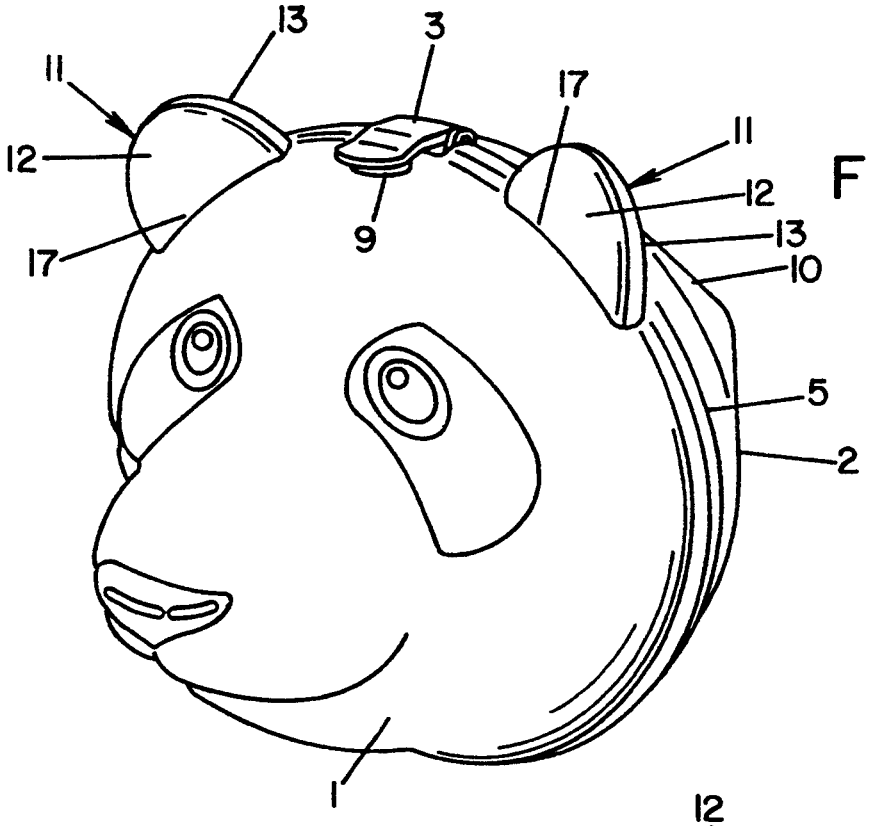
FIG. 1 represents a perspective view of a molded bag for children produced in accordance with the present invention imitating a face of an animal, particularly a panda.
Figure 2:
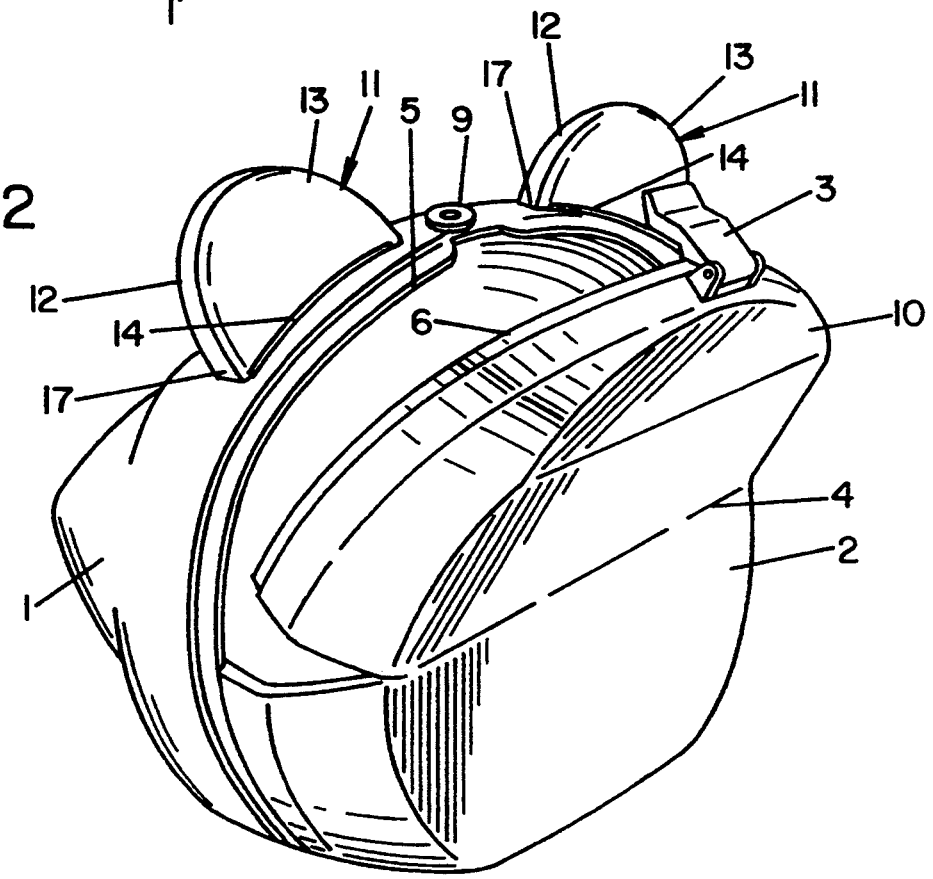
FIG. 2 shows in a perspective view the rear side of the bag shown in FIG. 1 with a lid slightly opened.
Figure 3:
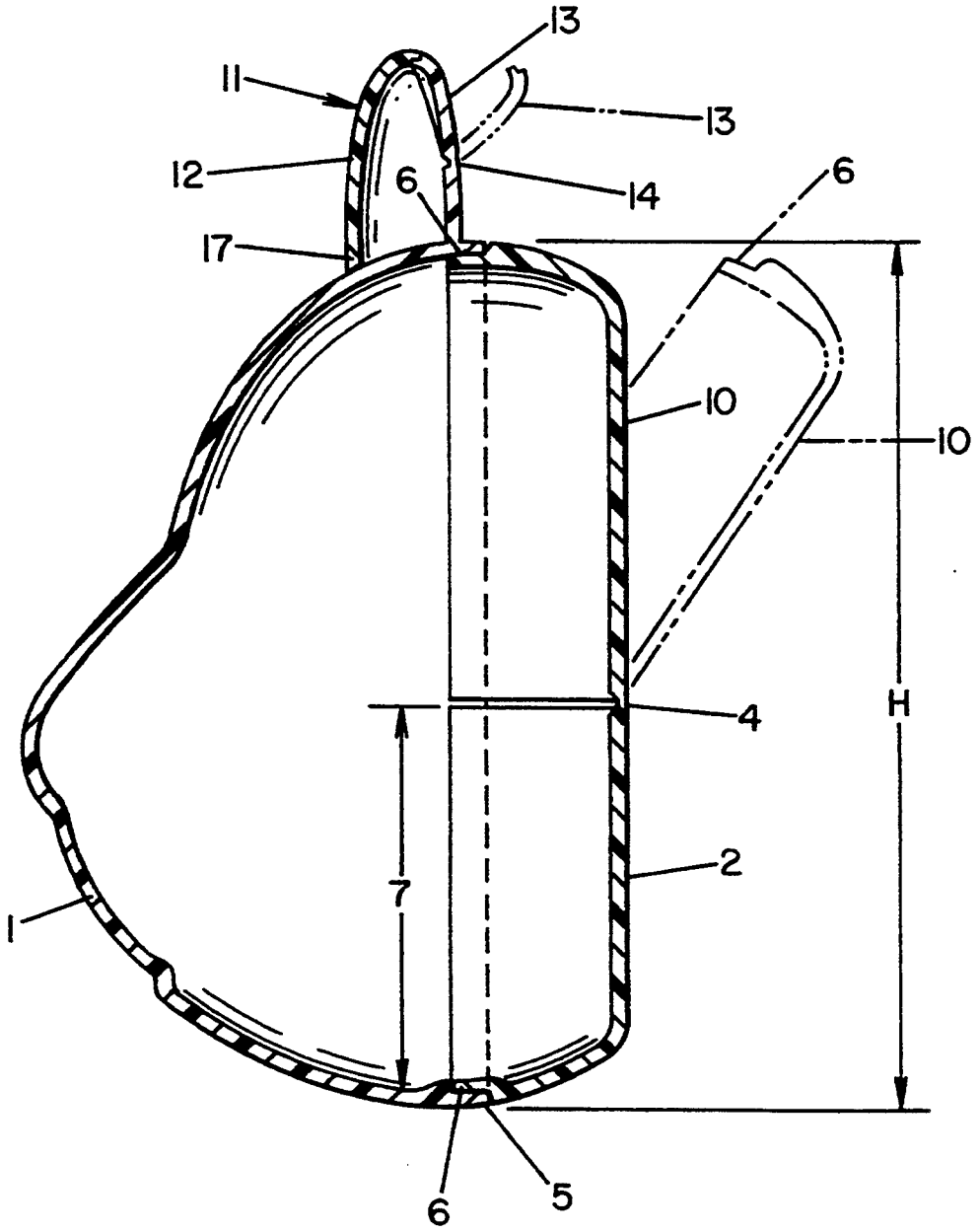
FIG. 3 is a central vertical sectional view of the bag shown in FIGS. 1 and 2 with lock means omitted and showing ears which open in the manner of the main body.
Figure 4:
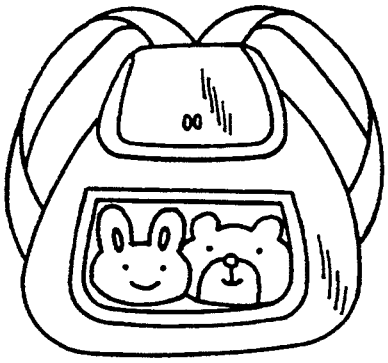
FIG. 4 (PRIOR ART)
FIGS. 4 through 8 illustrate various conventional bags for children having only limited ability for designing.
Figure 5:
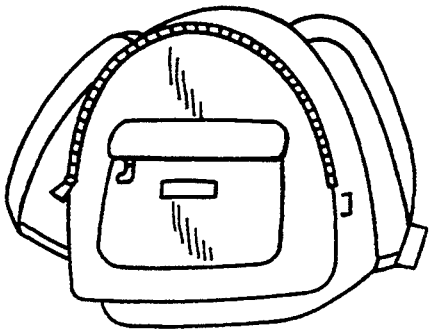
FIG. 5 (PRIOR ART)
Figure 6:
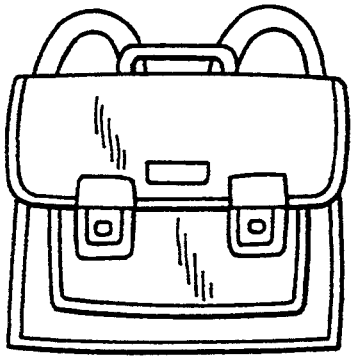
FIG. 6 (PRIOR ART)
Figure 7:
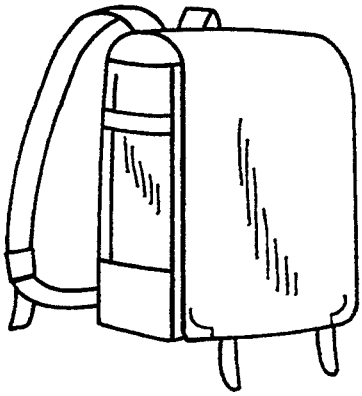
FIG. 7 (PRIOR ART)
Figure 8:
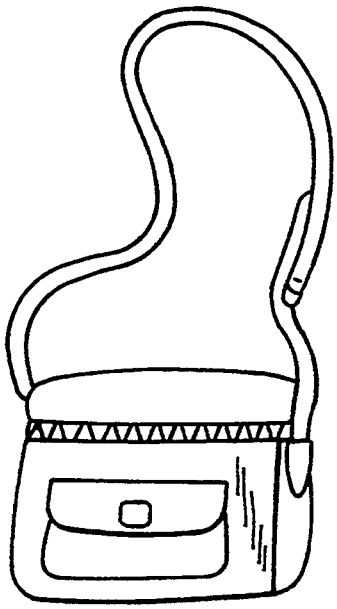
FIG. 8 (PRIOR ART)

Referring now to the drawings, particularly FIG. 1 through FIG. 3, a preferred embodiment according to the invention will be described in detail.

FIGS. 1 through 3 show a molded bag for children representing a panda face just like a real one, and having complicated tridimensional contours, which would never be readily produced by the prior art method. Of course, the method of the present invention can express not only animal faces, but also any other complicated contours on the bags moldable from plastic, including the face of leading characters in popular animations, popular actors or actresses, or model combat cars, rockets and other toys, with life-like preciseness. Accordingly, it is to be understood that the present invention is not limited in any sense to the panda face bag shown in the drawings.

In accordance with the present invention, an overall design of a bag is first determined and a model pattern for that design is fabricated of, for example, wood. In FIGS. 1 and 2, the design has been determined as the face of a panda, and a wooden model representing that design has been fabricated as a master model. On the basis of the wooden master model, metallic molds for injection molding are prepared comprising front mold halves for a front half portion 1 and rear mold halves for a rear half portion 2 of the panda face. Using these mold halves, the front half 1 of the bag can be molded from, for example, ABS resin, and the rear half 2 can be molded from, for example, polypropylene.

Needless to say, these plastic materials and molding techniques are merely illustrative and not limiting since they can be selected from a wide variety of possible candidates in accordance with the particular use and purposes of the bags.

As a characteristic feature, an inner half of the rear mold halves for molding the rear half portion 2 of the bag should be provided with at least one bead portion protruding outwardly preferably at its central region so as to produce at least one notched or thinned portion in the rear half 2 of the bag, as shown in FIG. 3, which constitutes a plastic hinge structure 4 integral with the main body of the bag. This bead portion may be located at a position in the range of from 80% to 20% of the height H (FIG. 3) from the bottom of the bag. In an example shown in FIG. 3, this bead portion (accordingly, the hinge 4) is located at a position corresponding to about 45% of the height H, so that an upper half portion 10 of the rear half 2 can be opened and closed as a lid.

Front half 1 and rear half 2 molded as mentioned above are assembled as shown in FIG. 3 wherein the circumferential edge 5 of the front half 1 is lapped over the circumferential edge 6 of the rear half 2. Lapping area 7 is subjected to electromagnetic induction heating to form a rigid bond. Lid 10, of course, is not bonded to the front half portion 1.

To make the bond at area 7, an appropriate means such as adhesives and high-frequency heating or ultrasonic heating may be utilized in accordance with the plastic materials used. On the top of the lid 10 is provided a metallic or plastic locking male member 3, as shown in FIGS. 1 and 2, which can be engaged with a locking female member 9 provided on the front half 1 of the bag to securely close the lid 10.

Figure 9:
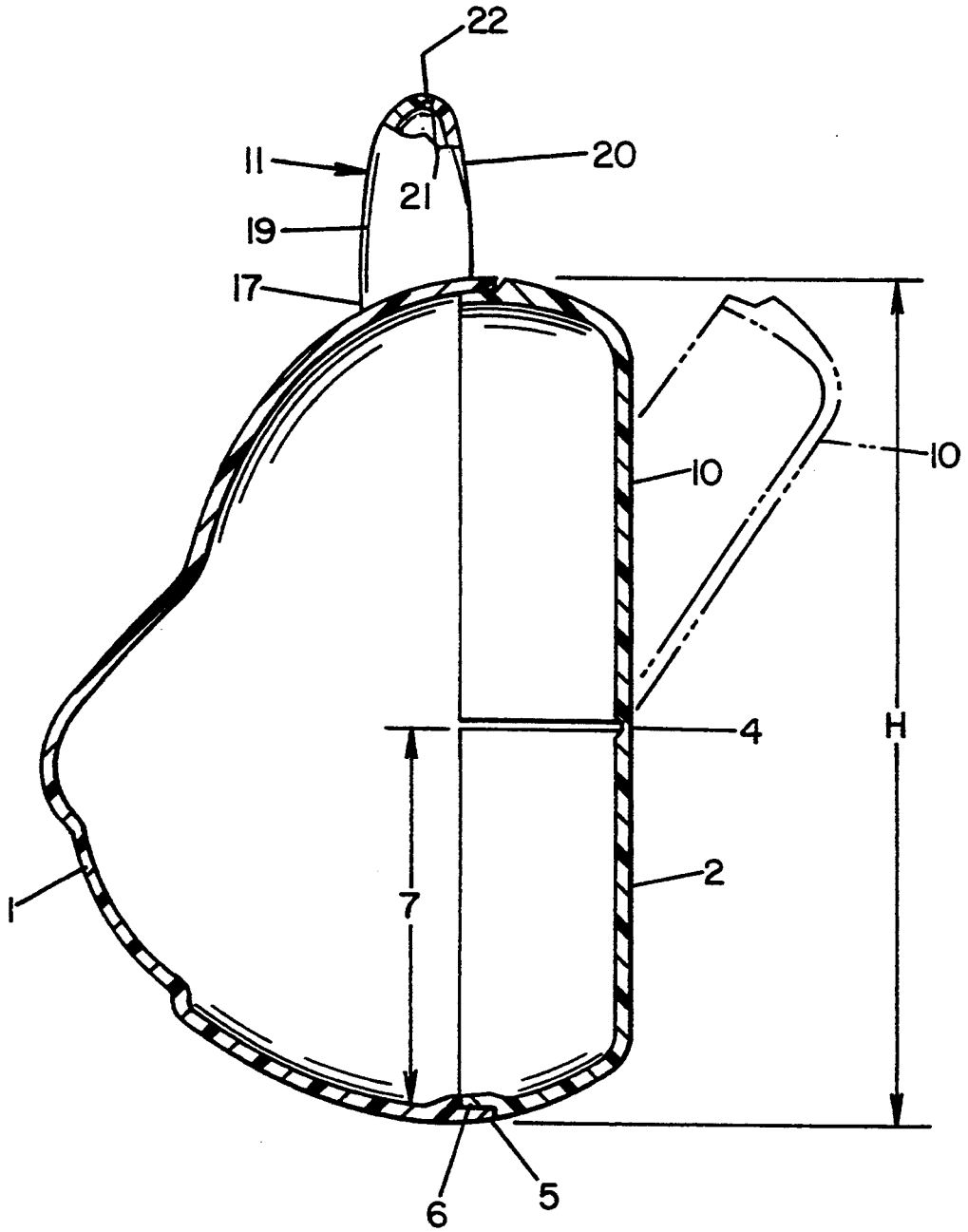
FIG. 9 is a view similar to FIG. 3 showing ears which are dividedly molded and bonded together.

Referring particularly to FIG. 3 of the drawings, if the ears of the animal, generally indicated by the numeral 11, are of enough thickness or volume to be split, they may be dividedly molded as an immobile front half 12 and an openable rear half 13 with a plastic hinge 14 in the same fashion as the front and rear half of the main body. Assembled front and rear halves of the ears may be attached at their bottom 17 to the top of the main body as by screws or the like so as to be utilized as pockets for receiving small articles. Where the ears of any selected models are thin and unsuitable for accommodating any articles, as shown in FIG. 9, dividedly molded front half 19 and rear half 20 of the ears may be bonded together, as with an adhesive around the entire circumferential edges 21 and 22 of front half 19 and rear half 20, respectively. Alternatively, ears of the animals may be produced by blow molding. Further, the ears, mouth and nose may be made of soft materials such as urethane and vinyl chloride and attached to the main body of the bag by any suitable means.

In addition, eyes of the animals can be injection molded from acrylic resin, then dyed black on the inside surface, and attached to selected locations as by adhesives.

The bag comprised of molded and assembled front and rear halves may have two straps attached at its rear half portion 2 to form a satchel or a knapsack, or a relatively long strap at the lateral sides to form a shoulder bag.

The outside surface of either or both of the front and rear halves of the bag may be colored by commingling pigments into plastic materials or by painting after molding.

As described above, in accordance with the present invention, children's bags of various types having complicated designs and contours, especially tridimensional shapes can easily be achieved with dynamically sufficient stiffness and rigidity due to the box-like construction. Moreover, the lid, easily openable and closable through the integrally formed plastic hinge, with good durability and excellent appearance contributes to augment the rigidity of the main body. Thus, children's bags according to the present invention are ones publicly favored, acceptable to children, stable in structure and precisely manufactured.

As the bag according to the present invention is dividedly molded into the front half and the rear half using separate molds prepared respectively for the front and the rear half of the bag, relatively complicated designs of tridimensional shapes can be freely and widely represented on the bag surface. The separately molded front half and rear half of the bag can be assembled together at their circumferential edges to form the strong, box-like construction, and the openable lid integrally molded and connected through the plastic hinge with the rear half portion of the bag can also contribute to form the stable, box-like construction when closed and locked on the front half portion. By virtue of the structural strength attributed by the lid, the bag can have a relatively large opening through which articles can easily be inserted into and brought out from the inside of the bag.

The plastic hinge provided integrally with the rear half portion of the bag is very slim in appearance and smooth, yet structurally strong, so that it does not affect overall strength and rigidity of the bag and can assure sufficient long-term durability of the bag.

We claim:

1. A molded bag for children comprising:

a front half portion and a rear half portion respectively molded by molds having complicated contours, said front and rear half portions forming together a main body of the bag, said front half portion and said rear half portion having circumferential edges for engaging each other, said front half portion and said rear half portion being connected to each other through a portion of said circumferential edges, said rear half portion constituting a lid in an area not connected to said front half portion, said lid being openable and closable through a hinge integrally molded with said rear half portion, said lid, when closed and locked on the top of the bag, permitting said main body of the bag to form a box construction to safely accommodate articles, and ears for receiving small articles, said ears having a front part attached to said front half of said main body and a rear part attached to said front part and being openable and closable with a plastic hinge.

2. A bag as recited in claim 1 wherein said portion of said circumferential edges connected to each other lies within a range of from 80% to 20% of the height from the bottom of the main body in which articles are accommodated.

3. A bag as recited in claim 1 wherein said portion of said circumferential edges connected to each other lies within a range of from 55% to 45% of the height from the bottom of the main body in which articles are accommodated.

4. A bag as recited in claim 1 wherein said complicated contours depict a face of a panda.

5. A bag as recited in claim 1 wherein said complicated contours depict a face of a favored character.

6. A bag as recited in claim 1, wherein at least a portion of said circumferential edges overlap.

7. A bag as recited in claim 6, wherein said circumferential edges are bonded in said portions of said circumferential edges which overlap.

8. A molded bag for children comprising:

a front half portion and a rear half portion respectively molded by molds having complicated contours, said front and rear half portions forming together a main body of the bag, said front half portion and said rear half portion having first circumferential edges for engaging each other, said front half portion and said rear half portion being connected to each other through a portion of said first circumfereintial edges, said rear half portion constituting a lid in an area not connected to said front half portion, said lid being openable and closable through a hinge integrally molded with said rear half portion, said lid, when closed and locked on the top of the bag, permitting said main body of the bag to form a box construction to safely accommodate articles, and ears having a front part attached to said front half portion of said main body, and a rear part being separately molded, and second circumferential edges on said front part and said rear part being bonded together.

* * * * *

UNITED STATES PATENT AND TRADEMARK OFFICE

CERTIFICATE OF CORRECTION

PATENT NO. : 5,379,911

DATED : January 10, 1995

INVENTOR(S) : Fumio Goto and Yasumasa Kasahara

It is certified that error appears in the above-identified patent and that said Letters Patent is hereby corrected as shown below:

Column 6, line 54, "circumfereintial" should read --circumferential--.

Signed and Sealed this

Ninth Day of June, 1998

*Attest:*

Bruce Lehman

BRUCE LEHMAN

*Attesting Officer*

*Commissioner of Patents and Trademarks*